US010190327B2

(12) United States Patent
Shindou

(10) Patent No.: US 10,190,327 B2
(45) Date of Patent: Jan. 29, 2019

(54) REINFORCING BAR BINDING MACHINE

(71) Applicant: MAX CO., LTD., Tokyo (JP)

(72) Inventor: Shigeki Shindou, Tokyo (JP)

(73) Assignee: MAX CO., LTD., Tokyo (JP)

( * ) Notice: Subject to any disclaimer, the term of this patent is extended or adjusted under 35 U.S.C. 154(b) by 516 days.

(21) Appl. No.: 14/868,418

(22) Filed: Sep. 29, 2015

(65) Prior Publication Data

US 2016/0090749 A1 Mar. 31, 2016

(30) Foreign Application Priority Data

Sep. 30, 2014 (JP) ..... 2014-200188

(51) Int. Cl.

| | |
|---|---|
| ***E04G 21/12*** | (2006.01) |
| ***B65B 13/04*** | (2006.01) |
| ***B65B 13/06*** | (2006.01) |
| ***B65B 13/28*** | (2006.01) |

(52) U.S. Cl.

CPC ..... *E04G 21/122* (2013.01); *B65B 13/04* (2013.01); *B65B 13/06* (2013.01); *B65B 13/285* (2013.01)

(58) Field of Classification Search

CPC ... E04G 21/122; E04G 21/123; B65B 13/025; B65B 13/285; B65B 13/04; B65B 13/06; B21F 15/04; B21F 7/00

See application file for complete search history.

(56) References Cited

U.S. PATENT DOCUMENTS

| | | | | |
|---|---|---|---|---|
| 6,000,443 | A | 12/1999 | Hayashi et al. | |
| 9,856,041 | B2 * | 1/2018 | Itagaki | B65B 13/22 |
| 2009/0283172 | A1 * | 11/2009 | Itagaki | E04G 21/122 140/119 |
| 2014/0246115 | A1 | 9/2014 | Itagaki | |
| 2015/0048194 | A1 | 2/2015 | Itagaki | |
| 2015/0232212 | A1 | 8/2015 | Itagaki | |
| 2016/0186451 | A1 | 6/2016 | Itagaki | |
| 2016/0297555 | A1 | 10/2016 | Itagaki | |
| 2017/0305584 | A1 | 10/2017 | Itagaki | |

FOREIGN PATENT DOCUMENTS

| | | | |
|---|---|---|---|
| CN | 203268339 | U | 11/2013 |
| JP | 11-169981 | A | 6/1999 |
| JP | 3531150 | B2 | 5/2004 |
| JP | 2010-1731 | A | 1/2010 |

* cited by examiner

*Primary Examiner* — Teresa M Ekiert
*Assistant Examiner* — Gregory Swiatocha
(74) *Attorney, Agent, or Firm* — Drinker Biddle & Reath LLP

(57) ABSTRACT

A reinforcing bar binding machine includes a wire reel which is supported on a binding machine main body, a feed motor which drives the wire reel, a twisting mechanism which twists and binds a wire, a twist motor which drives the twisting mechanism and a brake actuating unit which is actuated by the twist motor. The twist motor starts a normal rotation when the wire is fed by a predetermined amount. The twisting mechanism twists the wire to complete the binding after the twisting mechanism is advanced to a predetermined position by the normal rotation. The twist motor starts a reverse rotation after completing the binding, and the twisting mechanism is retracted to a stand-by position by the reverse rotation. Before completing the binding, the brake actuating unit brakes the wire reel to stop the wire reel and releases the braking with respect to the wire reel.

1 Claim, 12 Drawing Sheets

REINFORCING BAR BINDING MACHINE

CROSS-REFERENCE TO RELATED APPLICATION

This application is based on and claims priority under 35 USC119 from Japanese Patent Application No. 2014-200188 filed on Sep. 30, 2014.

TECHNICAL FIELD

The present invention relates to a reinforcing bar binding machine configured to wind and twist a wire around reinforcing bars to bind a plurality of reinforcing bars.

BACKGROUND

Conventionally, in this type of reinforcing bar binding machine, a feeding means feeds out a wire from a wire reel, and the wire fed out is curled to surround the periphery of reinforcing bars in a curl forming part. Further, the feeding of the wire is stopped when the wire is fed by a predetermined length, and a twisting mechanism twists the wire to tighten the reinforcing bars and thus to perform the binding. At this time, the wire reel continues to rotate by the inertia even when the feeding of the wire is stopped. Therefore, a braking means for braking the rotation of the wire reel is provided to stop the rotation of the wire reel.

At this time, there is an advantage that a dedicated drive source for the braking means may be omitted when the braking means is configured to operate in conjunction with the twist motor for driving the twisting mechanism.

For example, JP-B-3531150 discloses a structure that a rotational power of a twist motor is used, a brake switching mechanism is actuated by a convex shape formed on a rotation shaft, and a posture of a braking means is changed by the switching means to apply braking.

Further, CN203268339U discloses a structure that a holding member for holding a posture of a spring-biased braking means is actuated by using the forward and backward reciprocating movement of a twisting mechanism to apply braking.

SUMMARY

However, in the structure disclosed in JP-B-3531150, the braking means is actuated by repeated inputs that are synchronized with the rotation of the twist motor, and thus, the surrounding of a contact portion is damaged or worn due to the repeated inputs. Accordingly, there is a problem in durability. Further, since operating noise due to the repeated inputs occurs, there is a problem in quietness.

Further, in the structure disclosed in CN203268339U, braking is applied by a force of a spring immediately after the twisting mechanism is actuated, and the braking is always applied until the twisting operation is completed. That is, a spring load for actuating the braking means is always operated to the twisting mechanism, and thus, there is a problem that the power consumption of the twist motor is increased. Furthermore, the spring load is varied in accordance with the actuating position of the twisting mechanism, and thus, there is a possibility of adversely affecting the actuation of the twisting mechanism.

Therefore, the present invention aims to provide a reinforcing bar binding machine for braking a wire reel in conjunction with a twist motor, in which problems due to the repeated inputs do not occur and the influence of the braking operation on a twisting mechanism can be also reduced.

The present invention has been made to solve the above problems and is characterized by the following.

(1) A reinforcing bar binding machine of the present invention feeds a wire for binding, winds the wire around reinforcing bars and binds the reinforcing bars. The reinforcing bar binding machine includes a wire reel, a feed motor, a twisting mechanism, a twist motor and a brake actuating unit. The wire reel is rotatably supported on a binding machine main body. The feed motor rotationally drives the wire reel. The twisting mechanism twists and binds the wire. The twist motor drives the twisting mechanism. The brake actuating unit is actuated by using the twist motor as a power source. The twist motor starts a normal rotation when the wire is fed by a predetermined amount by the feed motor. The twisting mechanism twists the wire to complete the binding after the twisting mechanism is advanced to a predetermined position by the normal rotation of the twist motor. The twist motor starts a reverse rotation after completing the binding, and the twisting mechanism is retracted to a stand-by position by the reverse rotation of the twist motor. Before completing the binding, the brake actuating unit brakes the wire reel to stop a rotation of the wire reel and the brake actuating unit releases the braking with respect to the wire reel.

(2) in the reinforcing bar binding machine according to (1), before the twisting mechanism is advanced to the predetermined position, the brake actuating unit brakes the wire reel to stop the rotation of the wire reel and the brake actuating unit releases the braking with respect to the wire reel.

(3) In the reinforcing bar binding machine according to (1), the twist motor performs a reverse rotation operation before a normal rotation operation. The brake actuating unit brakes the wire reel by the reverse rotation operation.

(4) In the reinforcing bar binding machine according to (1), at a time of the normal rotation of the twist motor, the brake actuating unit brakes the wire reel to stop the rotation of the wire reel and the brake actuating unit releases the braking with respect to the wire reel.

(5) In the reinforcing bar binding machine according to (1), at a time of the reverse rotation of the twist motor, the brake actuating unit brakes the wire reel to stop the rotation of the wire reel and the brake actuating unit releases the braking with respect to the wire reel.

(6) In the reinforcing bar binding machine according to (5), the time of the reverse rotation of the twist motor is a time of the reverse rotation of the twist motor before the normal rotation or a time of the reverse rotation of the twist motor before completing the binding.

(7) In the reinforcing bar binding machine according to (1), the brake actuating unit brakes the wire reel to stop the rotation of the wire reel at a time of the reverse rotation of the twist motor, and the brake actuating unit releases the braking with respect to the wire reel at a time of the normal rotation of the twist motor.

(8) In the reinforcing bar binding machine according to (3), the brake actuating unit brakes the wire reel to stop the rotation of the wire reel at a time of the reverse rotation of the twist motor, and the brake actuating unit releases the braking with respect to the wire reel at a time of the normal rotation of the twist motor.

(9) In the reinforcing bar binding machine according to (7), the time of the reverse rotation of the twist motor is a time of the reverse rotation of the twist motor before the normal rotation or a time of the reverse rotation of the twist motor before completing the binding.

(10) In the reinforcing bar binding machine according to (8), the time of the reverse rotation of the twist motor is a time of the reverse rotation of the twist motor before the normal rotation or a time of the reverse rotation of the twist motor before completing the binding.

(11) In the reinforcing bar binding machine according to (1), the brake actuating unit includes a moving member, a braking member, a biasing member and a swinging prevention unit. The moving member moves back and forth together with the twisting mechanism. The braking member swings to operate the wire reel. The biasing member biases the braking member to a direction to brake the wire reel. The swinging prevention unit prevents the swinging of the braking member against a biasing force of the biasing member. When the twisting mechanism is in the stand-by position, the moving member operates the swinging prevention unit to allow the swinging prevention unit to prevent the swinging of the braking member. When the twisting mechanism is moved to a specific position, the prevention of the swinging of the braking member by the swinging prevention unit is released and the braking member operates the wire reel by the biasing force of the biasing member.

(12) in the reinforcing bar binding machine according to (1), the brake actuating unit includes a moving member, a braking member, a biasing member and a swinging promotion unit. The moving member moves back and forth together with the twisting mechanism. The braking member swings to operate the wire reel. The biasing member biases the braking member to a direction to be spaced apart from the wire reel. The swinging promotion unit swings the braking member against a biasing force of the biasing member. When the twisting mechanism is in the stand-by position, the braking member is spaced apart from the wire reel by the biasing force of the biasing member. When the twisting mechanism is moved to a specific position, the moving member operates the swinging promotion unit to allow the swinging promotion unit to swing the braking member against the biasing force of the biasing member and the braking member operates the wire reel.

The invention described in (1) is as described above. The brake actuating unit brakes the wire reel at a predetermined timing before the binding is completed, thereby stopping the rotation of the wire reel and releasing the braking with respect to the wire reel. That is, braking is with respect to the wire reel when the twisting mechanism is started to operate, and the braking is released when the wire reel is stopped. Therefore, most of the operation of the twisting mechanism is performed in a state where the braking is released. As a result, repeated inputs to the brake actuating unit do not occur and the influence of the braking operation on the twisting mechanism can be also reduced.

Further, the invention described in (2) is as described above. The brake actuating unit brakes the wire reel at a timing before the twisting mechanism is advanced to the predetermined position, thereby stopping the rotation of the wire reel and releasing the braking with respect to the wire reel. That is, since the braking operation is completed before the twisting mechanism twists the wire to perform the binding, the influence of the braking operation on the twisting mechanism can be reduced.

Further, the invention described in (3) is as described above. The twist motor is controlled to perform a reverse rotation operation before a normal rotation and the brake actuating unit brakes the wire reel by the reverse rotation operation. With such a configuration, the brake actuating unit is actuated by the reverse rotation operation that is not originally required for the twist operation. Therefore, the operation of the twisting mechanism and the operation of the brake actuating unit can be completely separated. That is, the influence of the braking operation on the twisting mechanism can be reduced.

Further, the invention described in (4) is as described above. The brake actuating unit brakes the wire reel at the time of the normal rotation of the twist motor, thereby stopping the rotation of the wire reel and releasing the braking with respect to the wire reel. That is, since the braking operation is completed before the twisting mechanism twists the wire to perform the binding when the twist motor is normally rotated, the influence of the braking operation on the twisting mechanism can be reduced.

Further, the invention described in (5) is as described above. The brake actuating unit brakes the wire reel at the time of the reverse rotation of the twist motor, thereby stopping the rotation of the wire reel and releasing the braking with respect to the wire reel. That is, the braking and the releasing of the braking are completed before the twisting mechanism starts its original actuation (advance) to perform a series of binding operations when the twist motor is reversely rotated. That is, since the braking and the releasing of the braking are completed before the twisting mechanism is advanced from the stand-by position (initial position) to start a series of binding operations, the influence of the working load of the braking operation on the twisting mechanism is reduced, and thus, the twisting mechanism can be accurately actuated.

Further, the invention described in (6) is as described above. At the time of the reverse rotation of the twist motor before the normal rotation or at the time of the reverse rotation of the twist motor before the binding is completed, the brake actuating unit brakes the wire reel to stop the rotation of the wire reel and releases the braking with respect to the wire reel. In this way, the same effects as (5) are obtained.

Further, the invention described in (7) and (8) is as described above. The brake actuating unit brakes the wire reel to stop the rotation of the wire reel at the time of the reverse rotation of the twist motor, and the brake actuating unit releases the braking with respect to the wire reel at the time of the normal rotation of the twist motor. That is, the braking and the releasing of the braking are completed before the twisting mechanism starts its original actuation (advance) to perform a series of binding operations. Therefore, the braking and the releasing of the braking are completed before the twisting mechanism is advanced from the stand-by position (initial position) to start a series of binding operations. As a result, the influence of the working load of the braking operation on the twisting mechanism is reduced, and thus, the twisting mechanism can be accurately actuated.

Further, a braking time is set as a period of time during which the twist motor is reversely rotated and the twisting mechanism is thus retracted, and then, the twist motor is normally rotated and the twisting mechanism is thus advanced to the stand-by position (initial position). Therefore, it is possible to secure a longer braking time in the period where the influence of the working load of the braking operation on the twisting mechanism is reduced. As a result, the braking can be efficiently and reliably applied.

Further, the invention described in (9) and (10) is as described above. The brake actuating unit brakes the wire reel to stop the rotation of the wire reel at the time of the reverse rotation of the twist motor before the normal rotation or at the time of the reverse rotation of the twist motor before the binding is completed, and the brake actuating unit releases the braking with respect to the wire reel at the time of the normal rotation of the twist motor. In this way, the same effects as (7) are obtained.

Further, the invention described in (11) is as described above. The moving member is operated to the swinging prevention unit to allow the swinging prevention unit to prevent the swinging of the braking member when the twisting mechanism is in the stand-by position, and the prevention of the swinging of the braking member by the swinging prevention unit is released and the braking member is operated to the wire reel by the biasing force of the biasing member when the twisting mechanism is moved to a specific position. According to this configuration, the moving member can be moved in conjunction with the advance or retreat of the twisting mechanism and the braking mechanism can be actuated by using the moving member.

Further, the invention described in (12) is as described above. The braking member is spaced apart from the wire reel by a biasing force of the biasing member when the twisting mechanism is in the stand-by position, and the moving member is operated to the swinging promotion unit to allow the swinging promotion unit to swing the braking member against the biasing force of the biasing member and the braking member is operated to the wire reel when the twisting mechanism is moved to a specific position. Also in the case of adopting this configuration, the moving member can be moved in conjunction with the advance or retreat of the twisting mechanism and the braking mechanism can be actuated by using the moving member.

DETAILED DESCRIPTION

First Embodiment

A first embodiment of the present invention will be described with reference to FIGS. 1 to 5.

Figure 1:
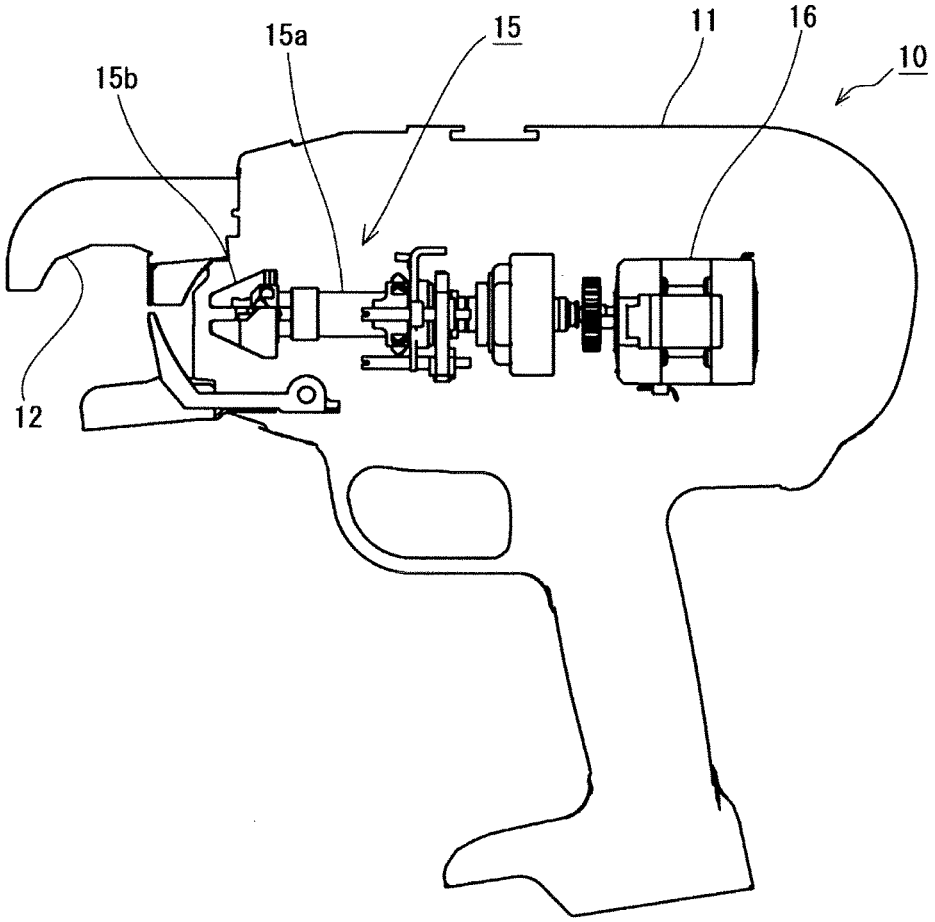
FIG. 1 is a schematic view showing an internal structure of a reinforcing bar binding machine, as seen from the right.
Figure 2:
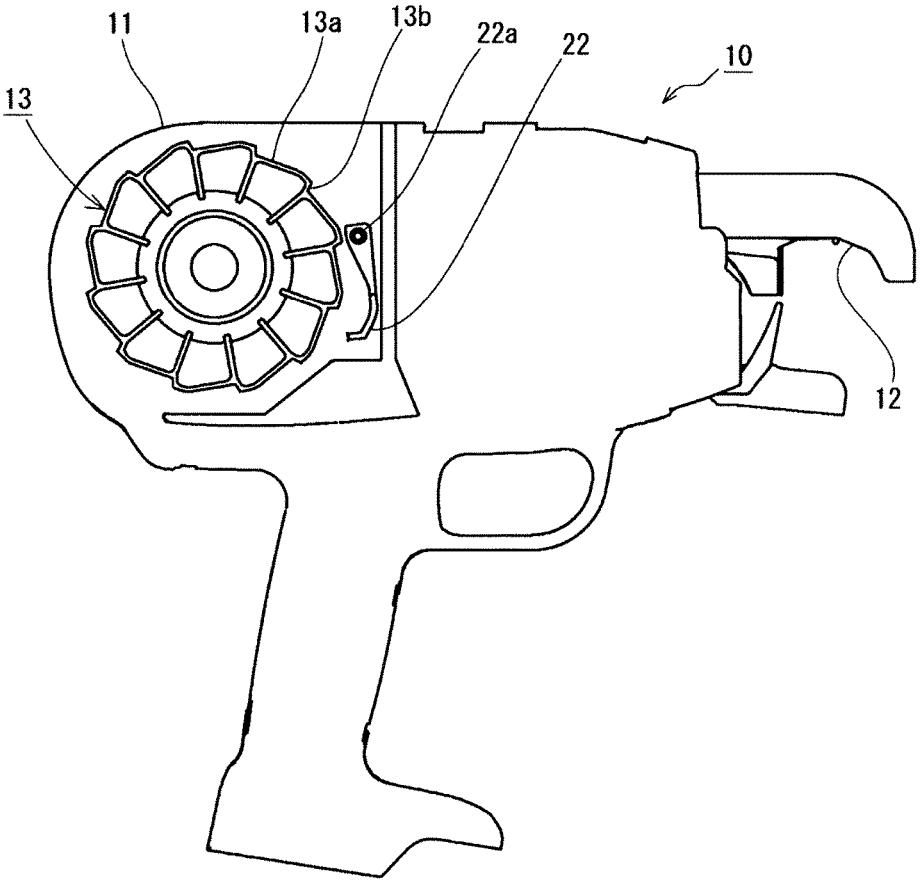
FIG. 2 is a schematic view showing the internal structure of the reinforcing bar binding machine, as seen from the left.
Figure 3:
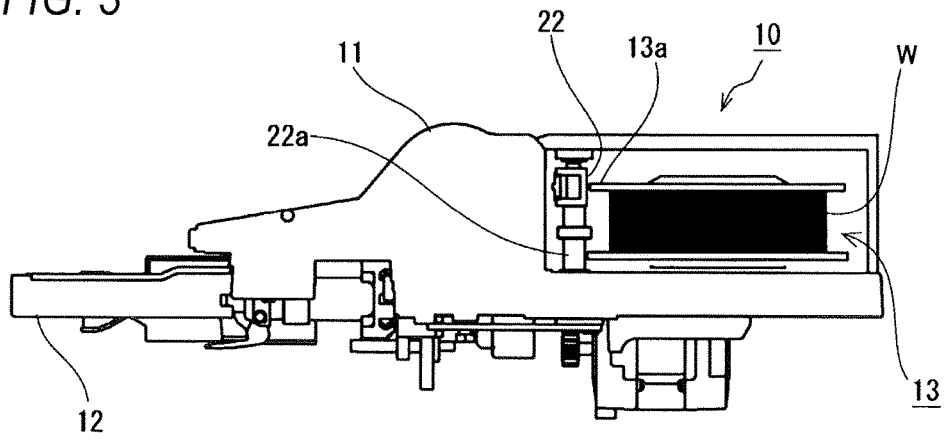
FIG. 3 is a schematic view showing the internal structure of the reinforcing bar binding machine, as seen from above.

As shown in FIGS. 1 to 3, a reinforcing bar binding machine 10 according to the present embodiment includes a wire reel 13 rotatably disposed in a binding machine main body 11. The reinforcing bar binding machine 10 is configured to feed out a wire W from the wire reel 13 by a predetermined length so that a plurality of wires W is wound around a reinforcing bar, and then, to twist and bind a plurality of bundles of the wire W.

The wire reel 13 is rotatably supported on the binding machine main body 11 and is configured to be detachably mounted to the binding machine main body 11 by the operation of a lever (not shown). The wire W for binding is wound around the wire reel 13. The wire W is pulled out from the wire reel 13 mounted to the binding machine main body 11 and is set in a feeding mechanism (not shown) of the binding machine main body 11.

The wire W, which is pulled out from the wire reel 13 and set in the feeding mechanism, is fed in the direction of a curl forming part 12 by a feed motor (not shown). The curl forming part 12 is configured to guide the wire W fed to a tip of a machine to be bent in a loop shape. As the wire W fed to the curl forming part 12 is guided along the curling forming part 12, a plurality of wires W is curled to surround the periphery of the reinforcing bar multiple times.

The wire reel 13 is provided at its side portion with a flange 13*a*. On the flange 13*a*, substantially saw-toothed locking step portions 13*b* are formed at predetermined intervals. The locking step portions 13*b* are adapted to face a braking member 22 (to be described). When a feeding operation by the feeding mechanism is completed, the braking member 22 is engaged with the locking step portion 13*b* to perform a braking operation, so that the rotation of the wire reel 13 is stopped.

Figure 4A:
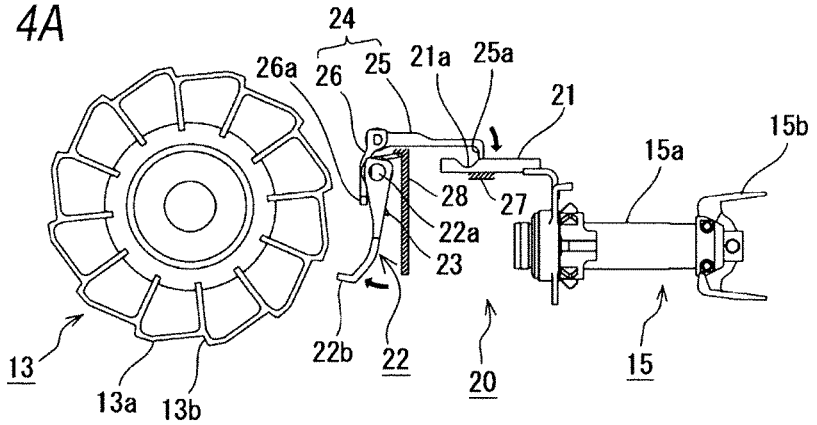
FIGS. 4A, 4B and 4C are explanatory views of a twisting mechanism and a brake actuating unit according to a first embodiment.
Figure 4B:
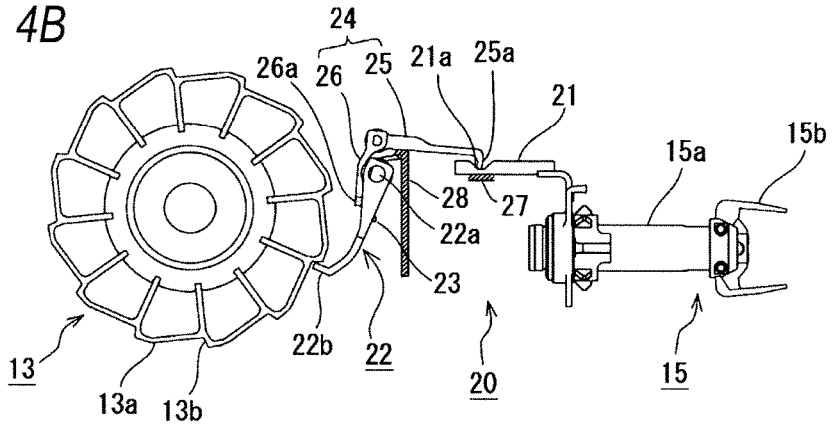
Figure 4C:
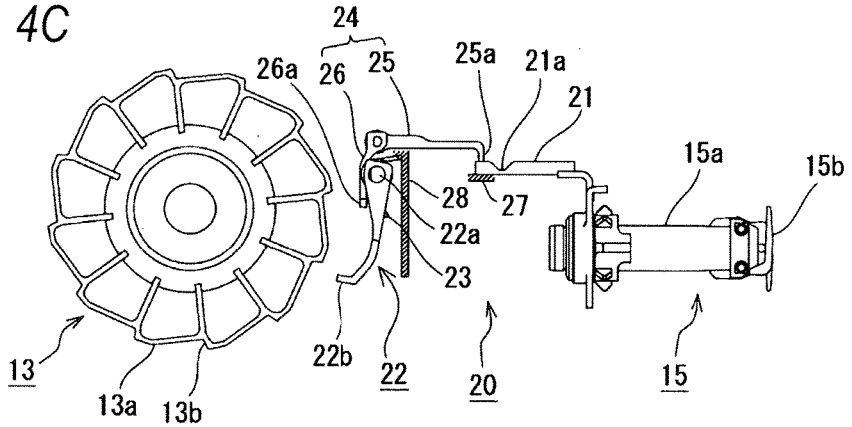

Further, the binding machine main body 11 is provided with a twisting mechanism 15 for twisting and binding the wire W. As shown in FIGS. 4A, 4B and 4C, the twisting mechanism 15 according to the present embodiment is intended to be driven by a twist motor 16 and is provided with a reciprocating cylinder part 15*a* and a twist hook 15*b*.

The twist motor 16 is provided for driving the twisting mechanism 15 and is controlled to start rotating at a specific timing before the feeding operation of the wire W is completed. In the present embodiment, the twist motor 16 is also used as a power source for actuating a brake actuating unit 20 (to be described later).

The rotation force of the twist motor 16 is transmitted to the twisting mechanism 15 via a gear or the like. In the inside of the twisting mechanism 15, a threaded shaft part for converting the rotation force into a linear movement is provided. The threaded shaft part is supported to be rotatable with respect to the binding machine main body 11 and has a threaded outer peripheral surface which is screwed to an inner peripheral surface of the reciprocating cylinder part 15*a*.

The reciprocating cylinder part 15*a* is a cylindrical member into which the threaded shaft part is inserted. The reciprocating cylinder part 15*a* is supported to be movable back and forth with respect to the binding machine main body 11. The inner peripheral surface of the reciprocating cylinder part 15*a* is threaded and screwed to the outer peripheral surface of the threaded shaft part. As the inner peripheral surface of the reciprocating cylinder part 15*a* and the outer peripheral surface of the threaded shaft part are screwed to each other in this way, the reciprocating cylinder part 15*a* is configured to move back and forth when the twist motor 16 is rotated.

The twist hook 15*b* is a pair of claw-shaped members attached to a tip of the reciprocating cylinder part 15*a*. The twist hook 15*b* is adapted to be opened and closed in accordance with the reciprocating operation of the reciprocating cylinder part 15*a* by a known structure.

The twisting mechanism 15 described above is operated as follows. First, when a trigger of the reinforcing bar binding machine 10 is operated, the wire W is fed by a predetermined amount and is wound in a loop shape by the curl forming part 12. Then, the twist motor 16 is normally rotated and the reciprocating cylinder part 15*a* is sent forward. As the reciprocating cylinder part 15*a* is sent to the front in this way, the twist hook 15*b* is advanced to a position where the twist hook is contactable to the wire W. At this time, since the twist hook 15*b* is actuated in a closed direction in conjunction with the advance of the reciprocating cylinder part 15*a*, the twist hook 15*b* grasps a portion of the wire loop. When the twisting mechanism 15 is advanced to a predetermined position (most advanced position), the twisting mechanism 15 is rotated in the predetermined position. With this operation, the twist hook 15*b* to hold the wire W is rotated and the wire W is thus twisted, so that the binding is completed. Meanwhile, while the twist motor 16 is normally rotated and the twisting mechanism 15 is advanced, i.e., while the reciprocating cylinder part 15*a* is advanced, a cutter (not shown) is operated to cut the wire W.

When the binding is completed as described above, the twist motor 16 starts to reversely rotate and the twisting mechanism 15 is moved rearward. At this time, the twist hook 15*b* is opened to release the wire W. The twist motor 16 is reversely rotated until the twisting mechanism 15 is moved to a stand-by position. When the twisting mechanism 15 is moved to the stand-by position, the twist motor 16 is stopped and a series of operation is completed.

Next, the brake actuating unit 20 according to the present embodiment is described.

As shown in FIGS. 4A, 4B and 4C, the brake actuating unit 20 according to the present embodiment includes a moving member 21, the braking member 22, a biasing member 23, and a swinging prevention unit 24.

The moving member 21 is a member that moves back and forth together with the twisting mechanism 15. The moving member 21 is fixed to the reciprocating cylinder part 15*a* of the twisting mechanism 15 and advances or retreats in conjunction with the reciprocating operation of the reciprocating cylinder part 15*a*. In other words, the moving member 21 is adapted to move forward integrally with the reciprocating cylinder part 15*a* when the twist motor 16 is normally rotated. Further, the moving member 21 is adapted to move rearward integrally with the reciprocating cylinder part 15*a* when the twist motor 16 is reversely rotated. The moving member 21 is guided to horizontally move by a guide part 27 that is a portion of the binding machine main body 11. An upper surface of the moving member 21 forms a sliding surface for sliding the swinging prevention unit 24 (to be described later). An engaging portion 21*a* for engaging with the swinging prevention unit 24 is recessed on the upper surface.

The braking member 22 is a member that is swung to be engageable with the wire reel 13. The braking member 22 can be swung with respect to the binding machine main body 11 with a pivot shaft 22*a* as an axis. At a tip of the braking member 22, a tip claw 22*b* for engaging with the locking step portion 13*b* of the wire reel 13 is formed. The tip claw 22*b* is arranged to face a peripheral edge portion of the wire reel 13.

The biasing member 23 is a torsion coil spring for biasing the braking member 22 in a direction to brake the wire reel 13, i.e., in a direction to be engaged with the wire reel 13. One end of the biasing member 23 is supported on a spring support part 28 that is a portion of the binding machine main body 11, and the other end thereof is engaged with the braking member 22 to bias the braking member 22.

The swinging prevention unit 24 is provided for preventing the swinging of the braking member 22 against a biasing force of the biasing member 23. As shown in FIGS. 4A, 4B and 4C, the swinging prevention unit 24 according to the present embodiment is configured by coupling a first arm part 25 and a second arm part 26 in a substantially L shape, and is attached to be swingable with respect to the binding machine main body 11 with the vicinity of the coupled portion as an axis. The swinging prevention unit 24 is always biased in a direction to be urged against the moving member 21 by a spring member (not shown).

A driven portion 25*a* is provided at a tip of the first arm part 25. The driven portion 25*a* is urged against the upper surface of the moving member 21 by the spring member described above. Therefore, when the moving member 21 is moved back and forth, the driven portion 25*a* is adapted to be slid along the upper surface of the moving member 21. Meanwhile, the upper surface of the moving member 21 is horizontal to the moving direction of the moving member 21. Therefore, the upper surface of the moving member 21 is formed such that the position of the driven portion 25*a* is not changed and the inclination of the swinging prevention unit 24 is also not changed when the driven portion 25*a* is slid along the upper surface of the moving member 21. On the other hand, the above-described engaging portion 21*a* is recessed on the upper surface of the moving member 21. Therefore, the upper surface of the moving member 21 is formed such that the driven portion 25*a* is fitted to the engaging portion 21*a* and the inclination of the swinging prevention unit 24 is changed when the driven portion 25*a* reaches the position of the engaging portion 21*a*.

A contact portion 26*a* is provided at a tip of the second arm part 26. The contact portion 26*a* interferes with the braking member 22 to prevent the pivoting of the braking member 22. As shown in FIG. 4A, when the driven portion 25*a* is not engaged with the engaging portion 21*a* and the driven portion 25*a* is slid along the upper surface of the moving member 21, the contact portion 26*a* presses the braking member 22 against the biasing force of the biasing member 23 such that the braking member 22 is not engaged with the wire reel 13. On the other hand, as shown in FIG. 4B, when the driven portion 25*a* is engaged with the engaging portion 21*a*, the inclination of the swinging prevention unit 24 is changed, so that the pressing of the braking member 22 by the contact portion 26*a* is released. As the pressing is released in this way, the braking member 22 is swung by the biasing force of the biasing member 23 and is engaged with the wire reel 13.

The brake actuating unit 20 is operated as follows.

First, in a stand-by state as shown in FIG. 4A, a trigger of the reinforcing bar binding machine 10 is operated and a twisting operation is thus performed. At this time, the twist motor 16 is rotated in a normal direction and the twisting mechanism 15 is advanced by the rotation of the twist motor 16. This movement allows the moving member 21 to move.

As shown in FIG. 4B, when the moving member 21 is moved to a position where the driven portion 25*a* is engaged with the engaging portion 21*a*, the inclination of the swinging prevention unit 24 is changed and the braking member 22 is thus engaged with the wire reel 13 by the biasing force of the biasing member 23. As the braking member 22 is engaged with the wire reel 13, the rotation of the wire reel 13 rotating by the inertia is stopped.

Then, when the moving member 21 is further moved, the driven portion 25*a* is disengaged from the engaging portion 21*a* and the contact portion 26*a* again prevents the swinging of the braking member 22, as shown in FIG. 4C. In this way, the engagement between the braking member 22 and the wire reel 13 is released. That is, the braking is released.

Further, when the twist motor 16 is further rotated in the normal direction, the twisting mechanism 15 is advanced to a predetermined position (most advanced position) and the twisting mechanism 15 is rotated. The binding is completed by this operation.

After the binding is completed, the twist motor 16 is rotated in a reverse direction as described above and is returned to the stand-by state as shown in FIG. 4A.

Figure 5:
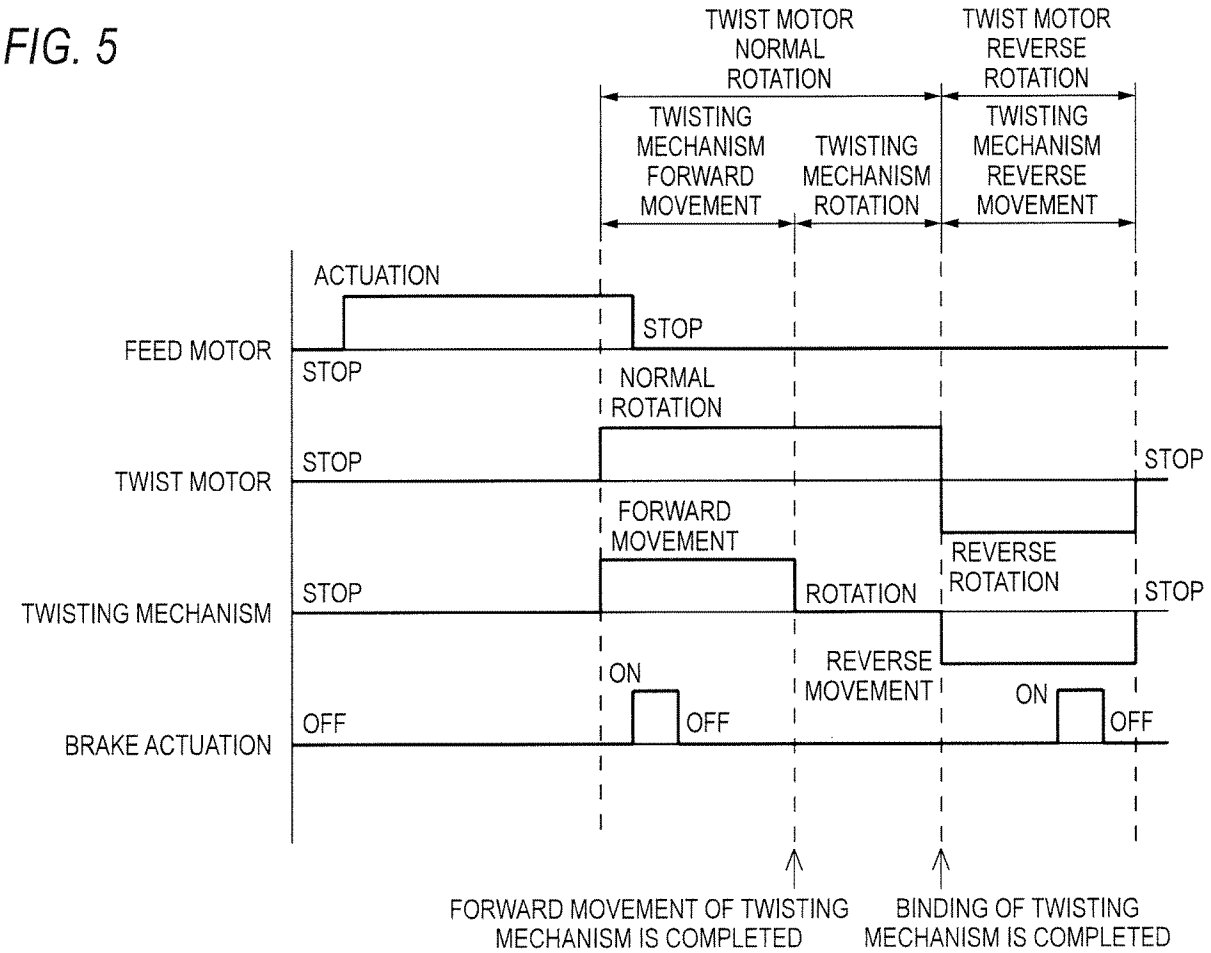
FIG. 5 is a time chart showing the actuation of a reinforcing bar binding machine according to the first embodiment.

A time chart of the actuation conditions described above is shown in FIG. 5. As shown in FIG. 5, in the present embodiment, at a predetermined timing (more specifically, at a timing before the twisting mechanism 15 is advanced to a predetermined position) before the binding is completed, the brake actuating unit 20 is engaged with the wire reel 13 to stop the rotation of the wire reel 13 and then is disengaged from the wire reel 13. Therefore, the brake actuating unit 20 is in a state of being disengaged from the wire reel 13 when the binding is completed.

According to this embodiment, braking is with respect to the wire reel 13 when the twisting mechanism 15 is started to operate, and the braking is released when the wire reel 13 is stopped. Therefore, most of the operation of the twisting mechanism 15 is performed in a state where the braking is released. As a result, repeated inputs to the brake actuating unit 20 do not occur and a period of time during which the braking is actuated by the biasing member 23 is short, so that the influence of the working load of the braking operation on the twisting mechanism 15 can be also reduced.

Since the twisting mechanism 15 is actuated (advanced) during the normal rotation of the twist motor 16 and the braking is thus applied before the binding in a series of binding operation is completed, there is no unnecessary operation and a period of time of the binding operation is shortened.

Figure 13:
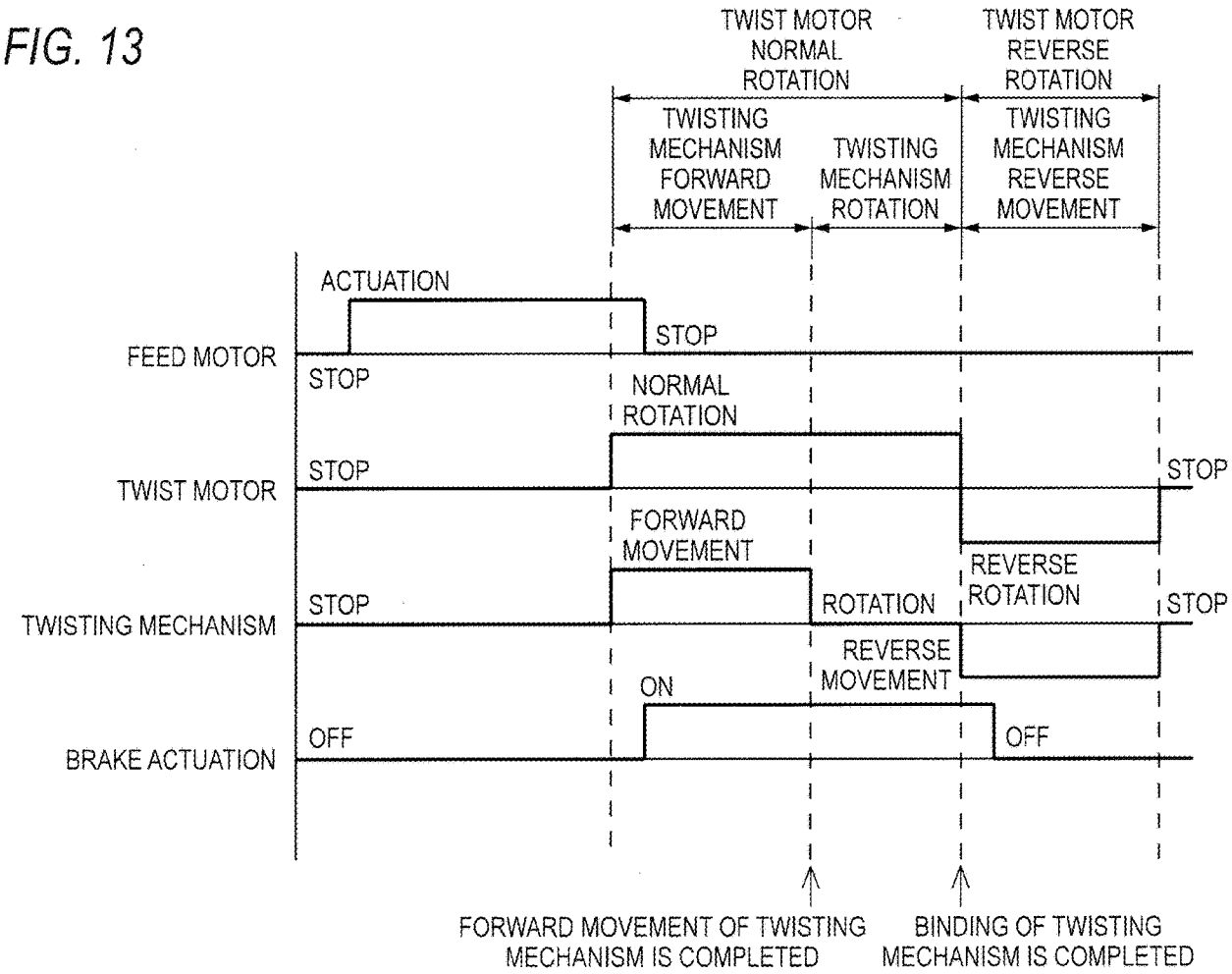
FIG. 13 is a time chart showing the actuation of a conventional reinforcing bar binding machine.

Meanwhile, in the conventional structure (e.g., CN203268339U), as in the time chart shown in FIG. 13, most of the operation of the twisting mechanism 15 is performed in a state where the braking is applied, and thus, the influence of the braking operation on the twisting mechanism 15 is increased. Accordingly, there is a problem that the power consumption of the twist motor 16 is increased or the control of the twisting mechanism 15 is adversely affected. However, according to the present embodiment, these problems do not occur.

Second Embodiment

A second embodiment of the present invention will be described with reference to FIGS. 6 and 7. Meanwhile, since a basic configuration of the present embodiment is not different from the first embodiment, a duplicated description is omitted and only the parts different from the first embodiment are described.

The present embodiment is characterized in that the twist motor 16 is controlled to perform a reverse rotation operation before starting to normally rotate, and the brake actuating unit 20 is engaged with the wire reel 13 to brake the wire reel 13 by the reverse rotation operation.

Figure 6A:
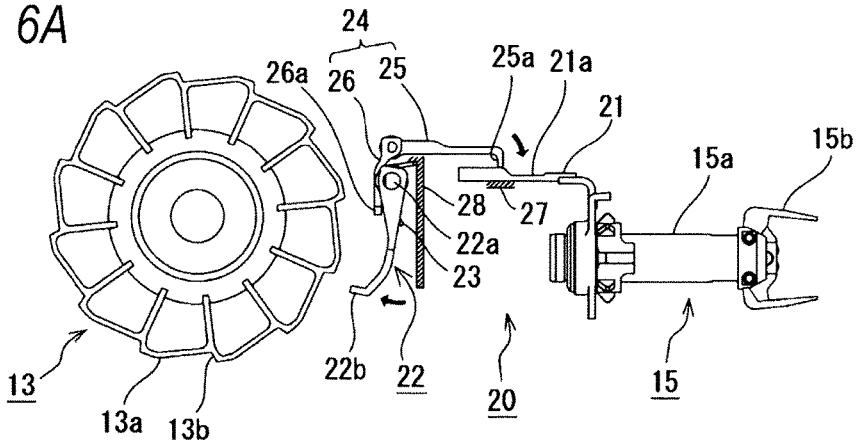
FIGS. 6A, 6B and 6C are explanatory views of a twisting mechanism and a brake actuating unit according to a second embodiment.
Figure 6B:
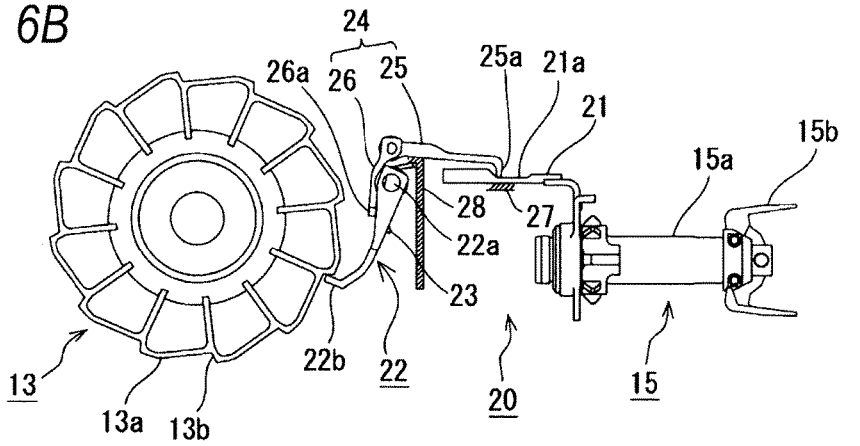
Figure 6C:
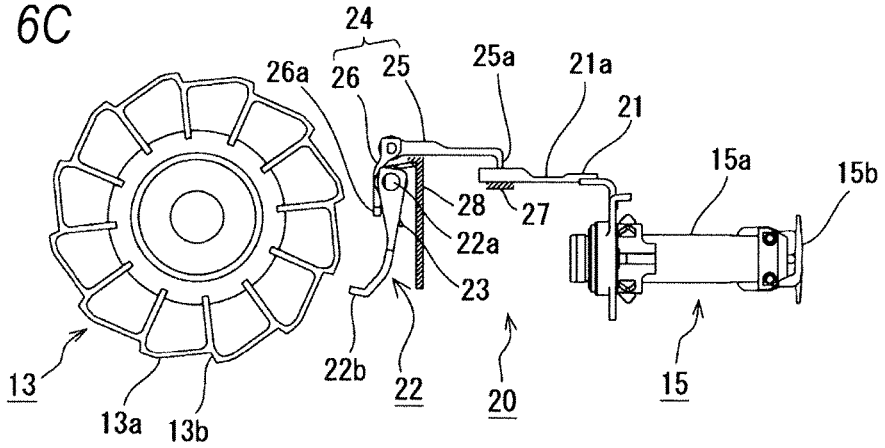
Figure 7:
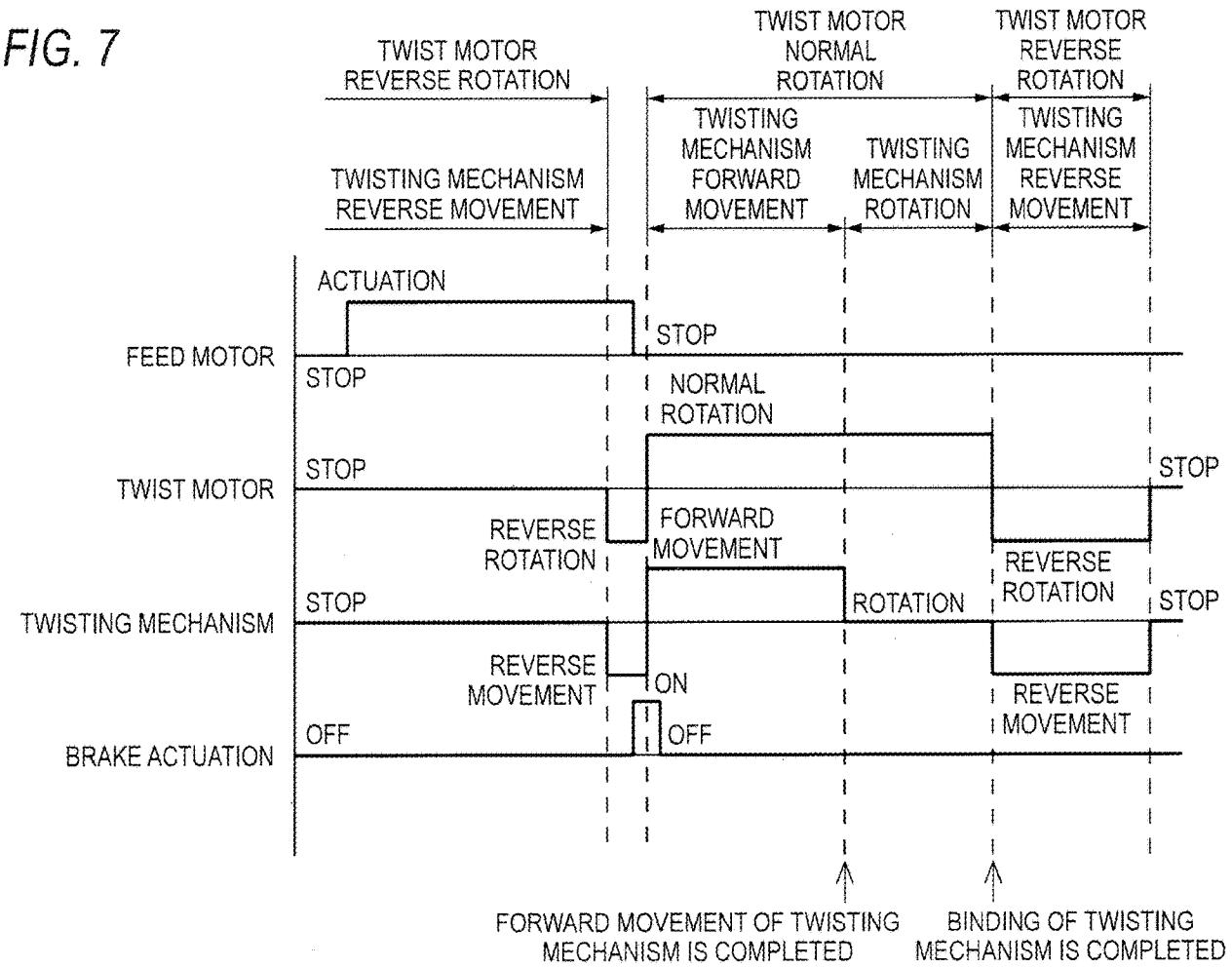
FIG. 7 is a time chart showing the actuation of a reinforcing bar binding machine according to the second embodiment.

As shown in FIGS. 6A, 6B and 6C, the moving member 21 of the present embodiment is formed with the engaging portion 21*a* in an arrangement different from the first embodiment. Specifically, the moving member 21 is arranged such that the driven portion 25*a* is not engaged with the engaging portion 21*a* even when the twist motor 16 is normally rotated from the stand-by state shown in FIG. 6A, and the driven portion 25*a* is engaged with the engaging portion 21*a* when the twist motor 16 is reversely rotated from the stand-by state shown in FIG. 6A.

The brake actuating unit 20 is operated as follows.

First, in the stand-by state shown in FIG. 6A, the trigger of the reinforcing bar binding machine 10 is operated and a twisting operation is thus performed. At this time, the twist motor 16 first performs a reverse rotation operation. By the reverse rotation operation, the twisting mechanism 15 is retracted and at the same time the moving member 21 is moved.

As shown in FIG. 6B, when the moving member 21 is moved to a position where the driven portion 25*a* is engaged with the engaging portion 21*a*, the inclination of the swinging prevention unit 24 is changed and the braking member 22 is thus engaged with the wire reel 13 by the biasing force of the biasing member 23. As the braking member 22 is engaged with the wire reel 13, the rotation of the wire reel 13 rotating by the inertia is stopped.

Then, the twist motor 16 starts to normally rotate and the driven portion 25*a* is disengaged from the engaging portion 21*a*, as shown in FIG. 6C. In this way, the contact portion 26*a* again prevents the swinging of the braking member 22, and thus, the engagement between the braking member 22 and the wire reel 13 is released.

Further, when the twist motor 16 is further rotated in the normal direction, the twisting mechanism 15 is advanced to a predetermined position (most advanced position) beyond the stand-by position and the twisting mechanism 15 is rotated. The binding is completed by this operation.

After the binding is completed, the twist motor 16 is rotated in the reverse direction as described above and is returned to the stand-by state as shown in FIG. 6A.

A time chart of the actuation conditions described above is shown in FIG. 7. As shown in FIG. 7, also in the present embodiment, at a predetermined timing (more specifically, at a timing before the twisting mechanism 15 is advanced to a predetermined position) before the binding is completed, the brake actuating unit 20 is engaged with the wire reel 13 to stop the rotation of the wire reel 13 and then is disengaged from the wire reel 13. Therefore, the brake actuating unit 20 is in a state of being disengaged from the wire reel 13 when the binding is completed.

Specifically, braking is with respect to the wire reel 13 before the twisting mechanism 15 is actuated, and the braking is released when the wire reel 13 is stopped. Further, the operation of the twisting mechanism 15 is performed after the braking operation is completed. According to this embodiment, the repeated inputs to the brake actuating unit 20 do not occur and a period of time during which the braking is actuated by the biasing member 23 is short, so that the influence of the working load of the braking operation on the twisting mechanism 15 can be also reduced.

Generally, depending on the remaining amount of the wire W in the wire reel 13, the weight of the wire reel 13 is changed and the braking load with respect to the brake actuating unit 20 is also changed. Therefore, the influence to the working load on the twisting mechanism 15 is large.

Thus, before the twisting mechanism 15 starts its original actuation (advance) to perform a series of binding operation, braking is applied in advance by the brake actuating unit 20 when the twist motor 16 is reversely rotated and the twisting mechanism 15 is thus retracted, and the braking is released when the twist motor 16 is normally rotated and the twisting mechanism 15 is thus advanced. Therefore, when the twisting mechanism 15 is advanced from a stand-by position (initial position) to start a series of binding operation, the influence of the working load of the braking operation on the twisting mechanism 15 is reduced, and thus, the twisting mechanism 15 can be accurately actuated.

In the present embodiment, a braking time refers to a period of time during which the twist motor 16 is reversely rotated and the twisting mechanism 15 is thus retracted, and then, the twist motor 16 is normally rotated and the twisting mechanism 15 is thus advanced to the stand-by position (initial position). Therefore, it is possible to secure a longer braking time in the period where the influence of the working load of the braking operation on the twisting mechanism 15 is reduced. As a result, the braking can be efficiently and reliably applied.

According to the present embodiment, the main working load of the braking operation occurs before the twist motor 16 is normally rotated (i.e., in the reverse rotation period). Therefore, the working load of the braking operation and the working load of the wire W cutting or the like can be dispersed. Further, since the reverse rotation period of the twist motor 16 is present, the temporal width during which the timing to perform the wire W cutting or the like can be set is increased. As a result, it is easy to finely adjust the timing to perform the wire W cutting or the like.

Furthermore, the releasing of the braking is performed when the twist motor 16 is normally rotated and the twisting mechanism 15 is thus advanced. Since the braking and the releasing of the braking are performed by using both the normal rotation and the reverse rotation in this way, the reverse rotation period can be set shorter, as compared to the case where the braking and the releasing of the braking are performed by using only the reverse rotation.

Meanwhile, although not specifically described in the present embodiment, the normal rotation operation may be performed before the twist motor 16 is reversely rotated. Namely, in the present embodiment, regardless of the timing when the reverse rotation operation is performed, the reverse rotation operation before the binding is completed allows the brake actuating unit 20 to brake the wire reel 13 and thus to stop the rotation of the wire reel 13.

Third Embodiment

A third embodiment of the present invention will be described with reference to FIGS. 8 and 9. Meanwhile, since a basic configuration of the present embodiment is not different from the first embodiment, a duplicated description is omitted and only the parts different from the first embodiment are described.

The present embodiment is the same as the second embodiment in that the twist motor 16 is controlled to perform the reverse rotation operation before starting to normally rotate and the brake actuating unit 20 is engaged with the wire reel 13 to brake the wire reel 13 by the reverse rotation operation. The present embodiment is different from the second embodiment in that, by an initial reverse rotation operation, the brake actuating unit 20 is engaged with the wire reel 13 to brake the wire reel 13, and then, the releasing of the braking is performed.

Figure 8A:
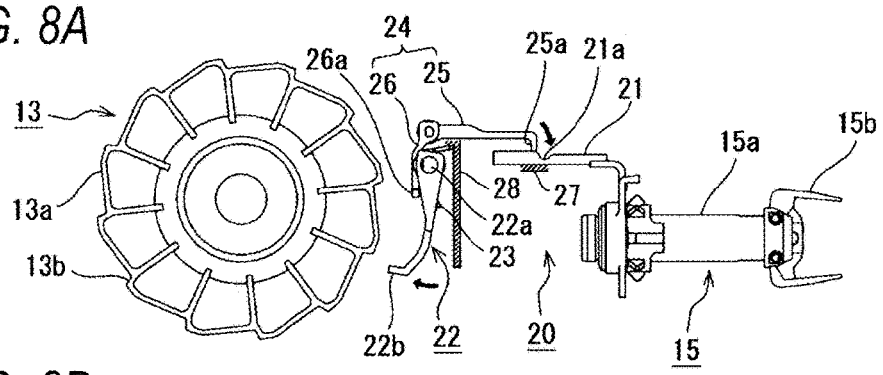
FIGS. 8A, 8B, 8C and 8D are explanatory views of a twisting mechanism and a brake actuating unit according to a third embodiment.
Figure 9:
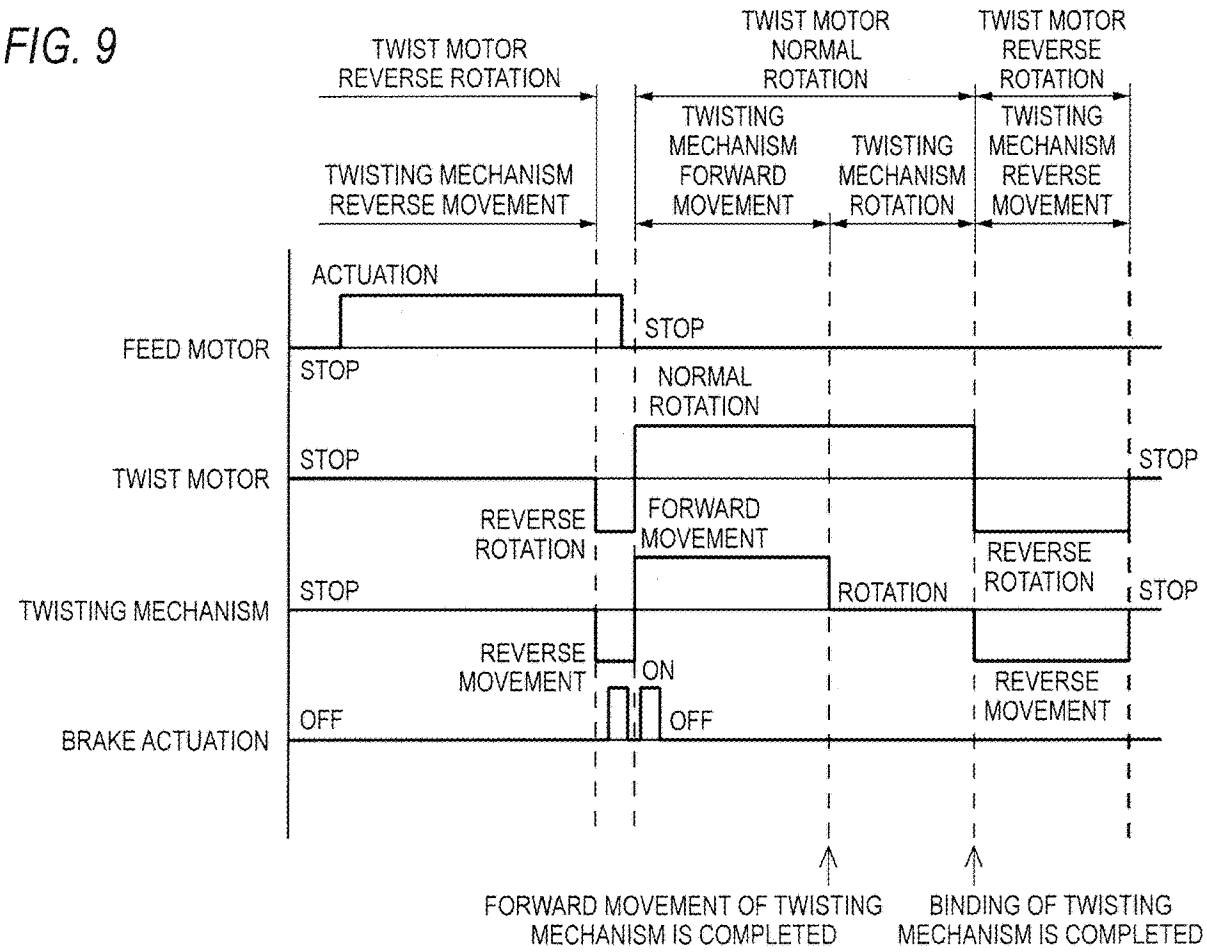
FIG. 9 is a time chart showing the actuation of a reinforcing bar binding machine according to the third embodiment.

The moving member 21 of the present embodiment is arranged such that the driven portion 25*a* is not engaged with the engaging portion 21*a* even when the twist motor 16 is normally rotated from the stand-by state shown in FIG. 8A, and the driven portion 25*a* is engaged with the engaging portion 21*a* when the twist motor 16 is reversely rotated from the stand-by state shown in FIG. 8A.

The brake actuating unit 20 is operated as follows.

First, in the stand-by state shown in FIG. 8A, the trigger of the reinforcing bar binding machine 10 is operated and a twisting operation is thus performed. At this time, the twist motor 16 first performs a reverse rotation operation in order to actuate the brake actuating unit 20. By the reverse rotation operation, the twisting mechanism 15 is retracted and at the same time the moving member 21 is moved.

Figure 8B:
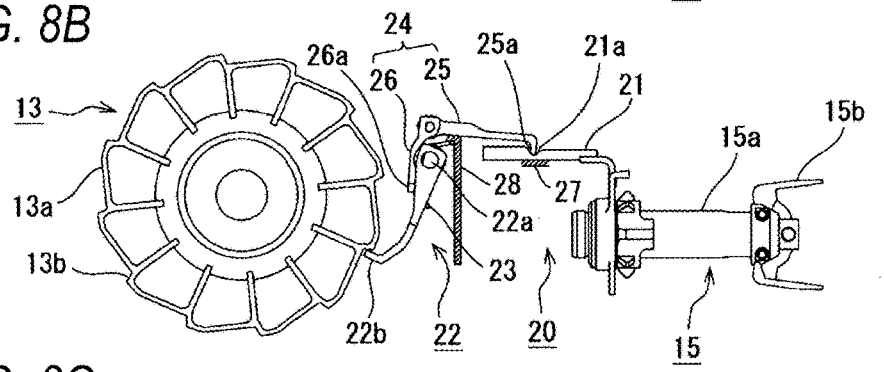

As shown in FIG. 8B, when the moving member 21 is moved to a position where the driven portion 25*a* is engaged with the engaging portion 21*a*, the inclination of the swinging prevention unit 24 is changed and the braking member 22 is thus engaged with the wire reel 13 by the biasing force of the biasing member 23. As the braking member 22 is engaged with the wire reel 13, the rotation of the wire reel 13 rotating by the inertia is stopped.

Figure 8C:
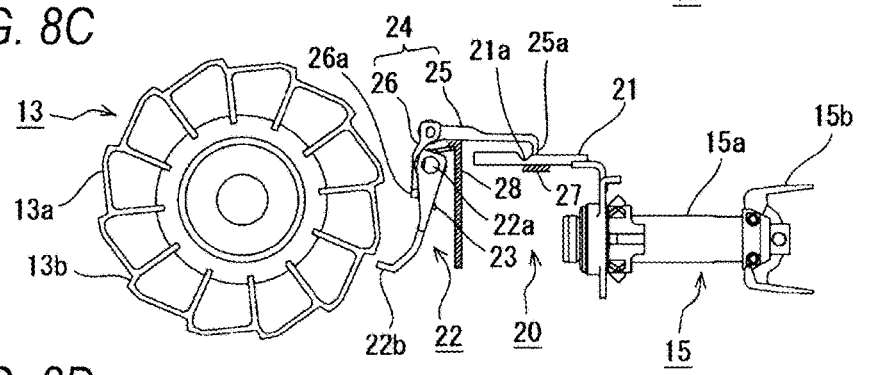

When the twist motor 16 further performs the reverse rotation operation, the driven portion 25*a* is disengaged from the engaging portion 21*a*, as shown in FIG. 8C. Thereby, the contact portion 26*a* again prevents the swinging of the braking member 22, so that the engagement between the braking member 22 and the wire reel 13 is released.

Figure 8D:
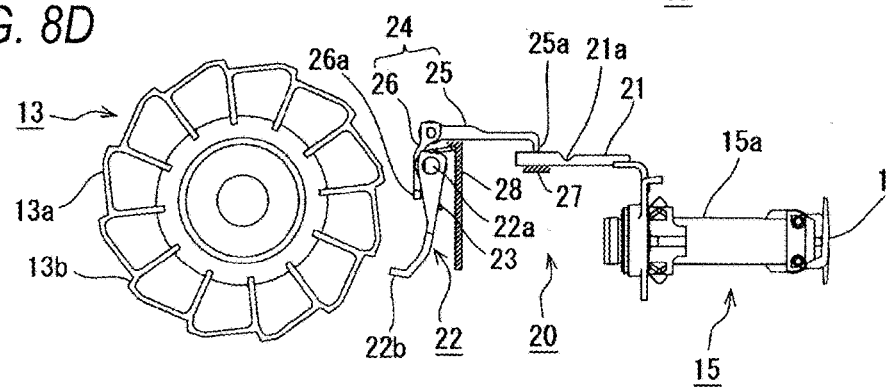

Then, the twist motor 16 starts to normally rotate. As shown in FIG. 8D, the twisting mechanism 15 is advanced to a predetermined position (most advanced position) beyond the stand-by position and the twisting mechanism 15 is rotated. The binding is completed by this operation.

After the binding is completed, the twist motor 16 is rotated in the reverse direction as described above and is returned to the stand-by state as shown in FIG. 8A.

A time chart of the actuation conditions described above is shown in FIG. 9. As shown in FIG. 9, also in the present embodiment, at a predetermined timing (more specifically, at a timing before the twisting mechanism 15 is advanced to a predetermined position) before the binding is completed, the brake actuating unit 20 is engaged with the wire reel 13 to stop the rotation of the wire reel 13 and then is disengaged from the wire reel 13. Therefore, the brake actuating unit 20 is in a state of being disengaged from the wire reel 13 when the binding is completed.

Specifically, braking is with respect to the wire reel 13 before the twisting mechanism 15 is actuated, and the braking is released when the wire reel 13 is stopped. Further, the operation of the twisting mechanism 15 is performed after the braking operation is completed. According to this embodiment, the repeated inputs to the brake actuating unit 20 do not occur and a period of time during which the braking is actuated by the biasing member 23 is short, so that the influence of the working load of the braking operation on the twisting mechanism 15 can be also reduced.

In this way, before the twisting mechanism 15 starts its original actuation (advance) to perform a series of binding operation, the twist motor 16 is reversely rotated and the twisting mechanism 15 is thus retracted, so that braking is applied in advance by the brake actuating unit 20. In addition, the twist motor 16 is further rotated reversely and the twisting mechanism 15 is thus retracted, so that the braking is released. Therefore, when the twisting mechanism 15 is advanced from a stand-by position (initial position) to start a series of binding operation, the influence of the working load of the braking operation on the twisting mechanism 15 is reduced, and thus, the twisting mechanism 15 can be accurately actuated. According to the present embodiment, the working load of the braking operation occurs in the reverse rotation period before the twist motor 16 is normally rotated. Therefore, the working load of the braking operation and the working load of the wire W cutting or the like can be dispersed. Further, since the reverse rotation period of the twist motor 16 is present, the temporal width during which the timing to perform the wire W cutting or the like can be set is increased. As a result, it is easy to finely adjust the timing to perform the wire W cutting or the like.

Meanwhile, although not specifically described in the present embodiment, the normal rotation operation may be performed before the twist motor 16 is reversely rotated. Namely, in the present embodiment, regardless of the timing when the reverse rotation operation is performed, the reverse rotation operation before the binding is completed allows the brake actuating unit 20 to brake the wire reel 13 and thus to stop the rotation of the wire reel 13.

Fourth Embodiment

A fourth embodiment of the present invention will be described with reference to FIGS. 10 to 12. Meanwhile, since a basic configuration of the present embodiment is not different from the first embodiment, a duplicated description is omitted and only the parts different from the first embodiment are described.

The present embodiment is characterized in that a brake actuating unit 30 different from that of the first embodiment is provided.

Figure 10A:
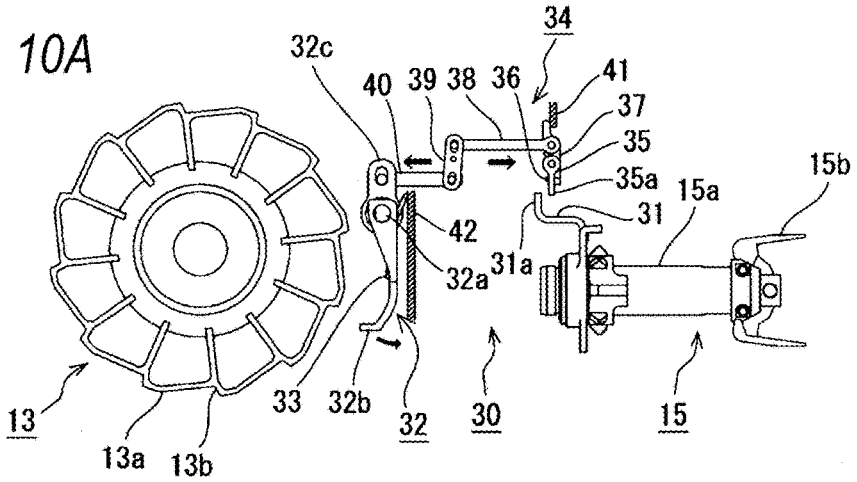
FIGS. 10A, 10B and 10C are explanatory views of a twisting mechanism and a brake actuating unit according to a fourth embodiment.
Figure 10B:
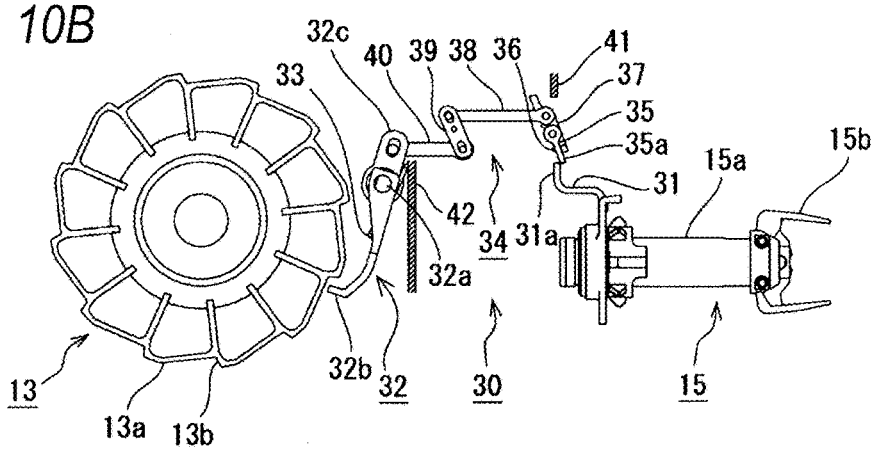
Figure 10C:
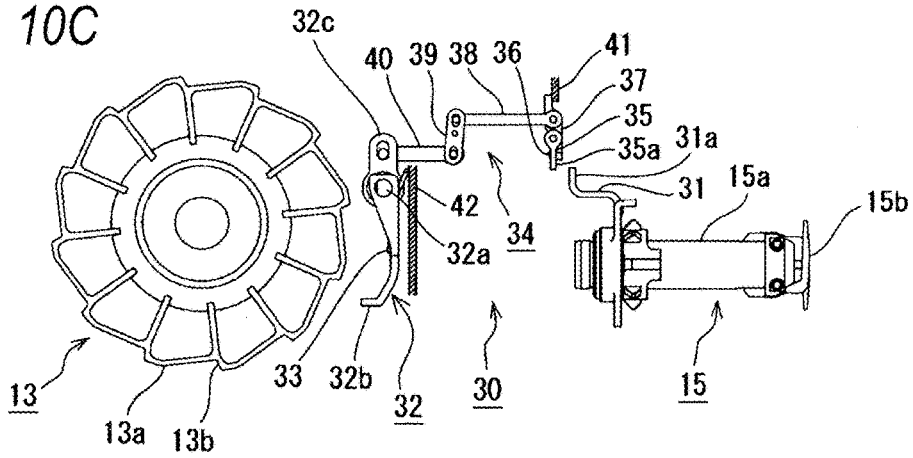

As shown in FIGS. 10A, 10B and 10C, the brake actuating unit 30 according to the present embodiment includes a moving member 31, a braking member 32, a biasing member 33, and a swinging promotion unit 34.

The moving member 31 is a member that moves back and forth together with the twisting mechanism 15. The moving member 31 is fixed to the reciprocating cylinder part 15*a* of the twisting mechanism 15 and advances or retreats in conjunction with the reciprocating operation of the reciprocating cylinder part 15*a*. In other words, the moving member 31 is adapted to move forward integrally with the reciprocating cylinder part 15*a* when the twist motor 16 is normally rotated. Further, the moving member 31 is adapted to move rearward integrally with the reciprocating cylinder part 15*a* when the twist motor 16 is reversely rotated. The moving member 31 is provided with an engaging portion 31*a* protruding to be contactable with a rotation member 35 (to be described later).

The braking member 32 is a member that is swung to be engageable with the wire reel 13. The braking member 32 can be swung with respect to the binding machine main body 11 with a pivot shaft 32*a* as an axis. At a tip of the braking member 32, a tip claw 32*b* for engaging with the locking step portion 13*b* of the wire reel 13 is formed. The tip claw 32*b* is arranged to face a peripheral edge portion of the wire reel 13. At an upper end portion (end portion opposite to the tip claw 32*b*) of the braking member 32, a connection portion 32*c* for connecting with the swinging promotion unit 34 (to be described later) is provided.

The biasing member 33 is a torsion coil spring for biasing the braking member 32 in a direction of being separated from the wire reel 13. One end of the biasing member 33 is supported on a spring support part 41 that is a portion of the binding machine main body 11, and the other end thereof is engaged with the braking member 32 to bias the braking member 32.

The swinging promotion unit 34 is provided for swinging the braking member 32 against the biasing force of the biasing member 33. As shown in FIGS. 10A, 10B and 10C, the swinging promotion unit 34 according to the present embodiment includes the rotation member 35, a spring member 36, a driven member 37, a first link part 38, a second link part 39, and a third link part 40.

The rotation member 35 is a member that is attached to be rotatable with respect to the driven member 37 (to be described later) and has a contact portion 35*a* protruding in a radial direction. The contact portion 35*a* is arranged at a position of being contactable with the engaging portion 31*a* of the moving member 31. When the moving member 31 is moved, the contact portion 35*a* is pressed and the rotation member 35 is thus rotated.

The driven member 37 is a member that constitutes a link mechanism together with the first link part 38, the second link part 39 and the third link part 40. When the rotation member 35 is rotated in a predetermined direction, the driven member 37 is rotated integrally with the rotation member 35 to actuate the link mechanism. The driven member 37 has a receiving portion 37*a* for engaging with the contact portion 35*a* of the rotation member 35 and a support portion 37*b* for engaging with a locking wall 41 formed as a portion of the binding machine main body 11. The support portion 37*b* is provided for holding the driven member 37 in a stand-by state. In the state where the support portion 37*b* is engaged with the engaging wall 41, the driven member 37 is in the stand-by state. The driven member 37 is rotatable from the stand-by state in a direction in which the support portion 37*b* is spaced apart from the engaging wall 41.

The spring member 36 is a torsion coil spring for biasing the rotation member 35 against the driven member 37. A biasing force of the spring member 36 allows the contact portion 35*a* of the rotation member 35 to be urged against the receiving portion 37*a* of the driven member 37.

The first link part 38, the second link part 39 and the third link part 40 constitute the link mechanism together with the driven member 37 and are intended to transmit a rotating force of the rotation member 35 to the braking member 32. An output side of the link mechanism is connected to the connection portion 32*c* of the braking member 32. When the link mechanism is actuated, the braking member 32 is adapted to be swung in conjunction with the link mechanism.

In the present embodiment, when the twist motor 16 is normally rotated, the driven member 37 is rotated to actuate the link mechanism and the braking member 32 is adapted to be actuated in conjunction with the link mechanism. On the other hand, when the twist motor 16 is reversely rotated, the driven member 37 is not rotated, i.e., the link mechanism is not actuated, so that the braking member 32 is not actuated.

Figure 11A:
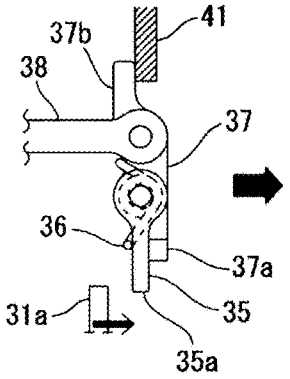
FIGS. 11A, 11B, 11C, 11D, 11E and 11F are views for explaining the actuation of a swinging prevention unit according to the fourth embodiment.
Figure 11B:
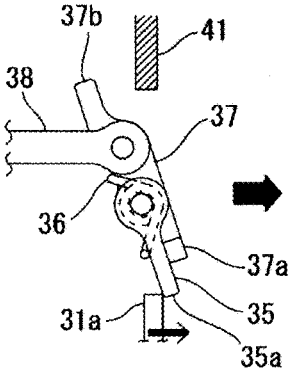
Figure 11C:
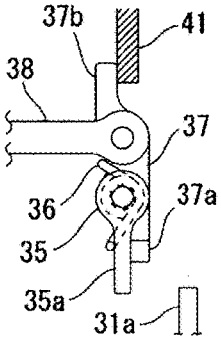

Specifically, as shown in FIGS. 11A to 11C, when the twist motor 16 is normally rotated, the moving member 31 is advanced along with the advance of the twisting mechanism 15 (the moving member 31 is moved to the right direction as shown in FIGS. 11A through 11F). As shown in FIG. 11B, the rotation member 35 is rotated when the engaging portion 31*a* of the moving member 31 is brought into contact with the contact portion 35*a* of the rotation member 35. At this time, the rotation member 35 is rotated in a direction in which the contact portion 35*a* of the rotation member 35 presses the receiving portion 37*a* of the driven member 37, and hence, the rotation member 35 and the driven member 37 are rotated integrally. As the driven member 37 is rotated, the link mechanism is actuated. The braking member 32 is swung in conjunction with the link mechanism (braking is applied). Further, as shown in FIG. 11C, when the moving member 31 is further advanced and the engagement between the engaging portion 31*a* and the contact portion 35*a* is thus released, the braking member 32 is swung to the direction of the stand-by position by a biasing force of the biasing member 33 (braking is released). When the braking member 32 is swung to the direction of the stand-by position, the link mechanism is actuated in conjunction with the braking member 32, and the rotation member 35 and the driven member 37 are returned to the stand-by position.

Figure 11F:
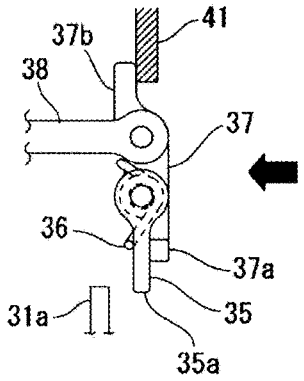
Figure 11E:
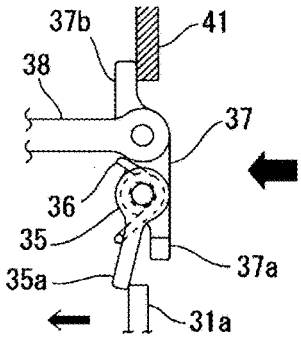
Figure 11D:
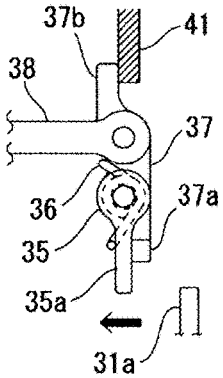
Figure 12:
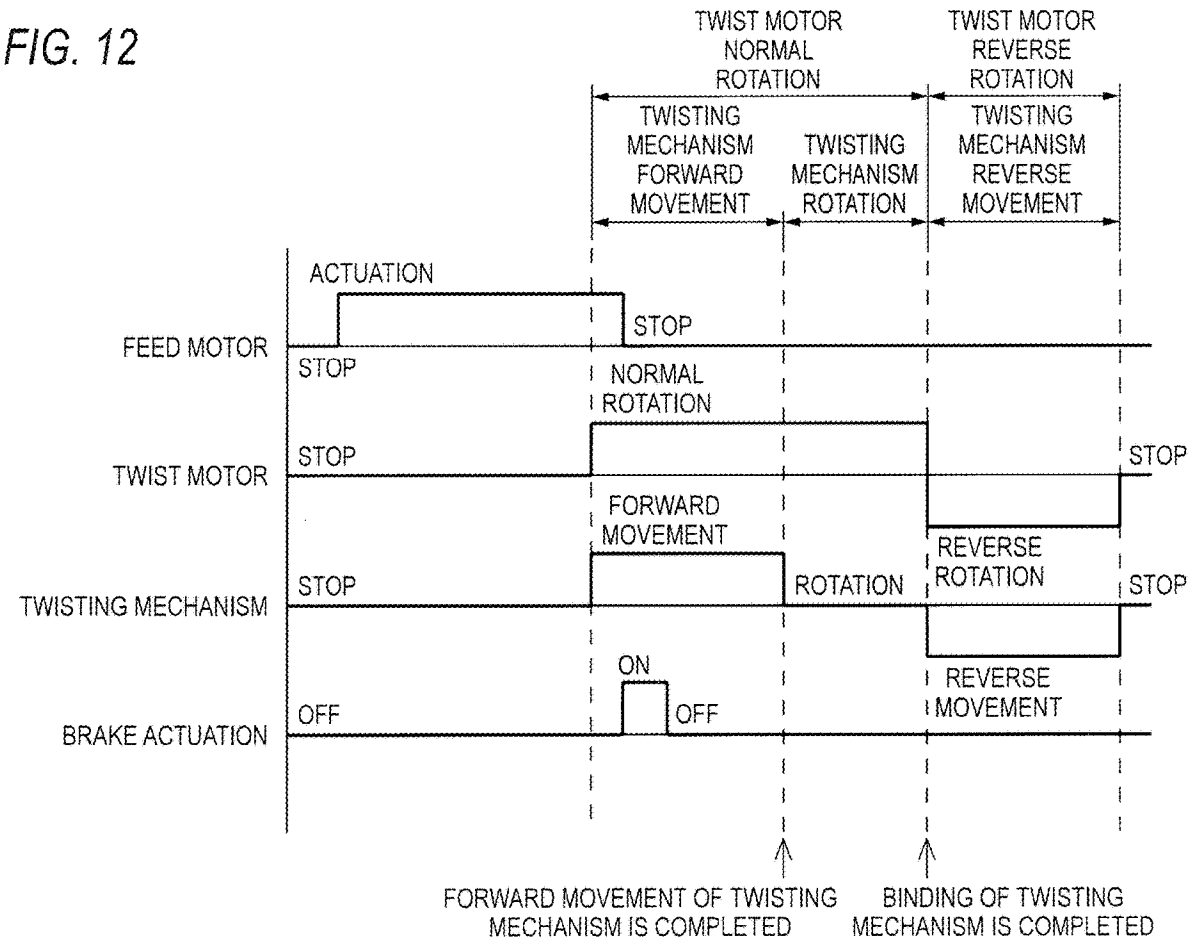
FIG. 12 is a time chart showing the actuation of a reinforcing bar binding machine according to the fourth embodiment.

Further, as shown in FIGS. 11D to 11F, the moving member 31 is retracted along with the retreat of the twisting mechanism 15 (the moving member 31 is moved to the left direction as shown in FIGS. 11A through 11F) when the twist motor 16 is reversely rotated. As shown in FIG. 11E, the rotation member 35 is rotated when the engaging portion 31*a* of the moving member 31 is brought into contact with the contact portion 35*a* of the rotation member 35. At this time, the rotation member 35 is rotated in a direction in which the contact portion 35*a* of the rotation member 35 is spaced apart from the receiving portion 37*a* of the driven member 37. Therefore, the rotating force of the rotation member 35 is not transmitted to the driven member 37, and thus, the driven member 37 is not rotated. Since the driven member 37 is not rotated, the link mechanism and the braking member 32 are also not actuated. Further, as shown in FIG. 11F, when the moving member 31 is further retracted and the engagement between the engaging portion 31*a* and the contact portion 35*a* is thus released, the rotation member 35 is returned to the stand-by position by the biasing force of the spring member 36.

The brake actuating unit 30 described above is operated as follows.

First, in the stand-by state as shown in FIG. 10A, the braking member 32 is in a state of being spaced apart from the wire reel 13 by the biasing force of the biasing member 33. When the trigger of the reinforcing bar binding machine 10 is operated from the stand-by state and a twisting operation is thus performed, the twist motor 16 is normally rotated and the twisting mechanism 16 is advanced by the rotation of the twist motor 16. This movement allows the moving member 31 to move.

As shown in FIG. 10B, when the moving member 31 is moved to a position where the engaging portion 31*a* is engaged with the contact portion 35*a*, the moving member 31 pushes the rotation member 35 and the rotation member 35 is thus rotated together with the driven member 37. In this way, the link mechanism is actuated to swing the braking member 32 against the biasing force of the biasing member 33, and the braking member 32 is engaged with the wire reel 13. As the braking member 32 is engaged with the wire reel 13, the rotation of the wire reel 13 rotating by the inertia is stopped.

Then, when the moving member 31 is further moved, the engagement between the engaging portion 31*a* and the contact portion 35*a* is released and the braking member 32 is returned to the stand-by position by the biasing force of the biasing member 33, as shown in FIG. 10C.

Further, when the twist motor 16 is further rotated in the normal direction, the twisting mechanism 15 is advanced to a predetermined position (most advanced position) and the twisting mechanism 15 is rotated. The binding is completed by this operation.

After the binding is completed, the twist motor 16 is rotated in the reverse direction as described above and is returned to the stand-by state as shown in FIG. 10A.

A time chart of the actuation conditions described above is shown in FIG. 12. As shown in FIG. 12, also in the present embodiment, at a predetermined timing (more specifically, at a timing before the twisting mechanism 15 is advanced to a predetermined position) before the binding is completed, the brake actuating unit 30 is engaged with the wire reel 13 to stop the rotation of the wire reel 13 and then is disengaged from the wire reel 13. Therefore, the brake actuating unit 30 is in a state of being disengaged from the wire reel 13 when the binding is completed.

According to this embodiment, braking is with respect to the wire reel 13 when the twisting mechanism 15 is started to operate, and the braking is released when the wire reel 13 is stopped. Therefore, most of the operation of the twisting mechanism 15 is performed in a state where the braking is released. As a result, the repetitive input to the brake actuating unit 30 does not occur and a period of time during which the braking is actuated by the biasing member 33 is short, so that the influence of the working load of the braking operation on the twisting mechanism 15 can be also reduced.

Meanwhile, in the above embodiment, the braking member 22 is engaged with the locking step portion 13*b* of the wire reel 13, thereby braking the wire reel 13. Any other method may be used to brake the wire reel 13. For example, the braking member may be pressed and frictionally slid against a peripheral edge portion of the wire reel 13 and the wire reel 13 may be braked by the friction force.

What is claimed is:

1. A reinforcing bar binding machine i) which includes a binding machine main body, ii) which feeds a wire which is wound around a wire reel rotatably supported on the binding machine main body, iii) which winds the wire around reinforcing bars, and iv) which binds the reinforcing bars, the reinforcing bar binding machine comprising:

a feed motor that feeds the wire which is wound around the wire reel, wherein the wire reel is rotated in accordance with feeding the wire by the feed motor;

a curl forming part that curls the wire fed by the feed motor, along a periphery of the reinforcing bars;

a twisting mechanism that binds the reinforcing bars by twisting the wire curled by the curl forming part;

a twist motor that drives the twisting mechanism; and a brake actuating unit that is actuated by the twist motor and that stops a rotation of the wire reel by engaging with the wire reel, wherein the twist motor starts a normal rotation when the wire is fed by a predetermined amount by the feed motor, the twisting mechanism twists the wire to complete the binding after the twisting mechanism is advanced to a predetermined position by the normal rotation of the twist motor, the twist motor starts a reverse rotation after completing the binding, and the twisting mechanism is retracted to a stand-by position by the reverse rotation of the twist motor, the brake actuating unit stops the rotation of the wire reel by engaging with the wire reel, i) when the twist motor starts the normal rotation and when the twisting mechanism starts to be advanced, or ii) after the twist motor starts the normal rotation and after the twisting mechanism starts to be advanced, and the brake actuating unit releases an engagement with respect to the wire reel before the twist motor starts the reverse rotation.

* * * * *